US009540718B2

(12) United States Patent
Ishida et al.

(10) Patent No.: US 9,540,718 B2
(45) Date of Patent: Jan. 10, 2017

(54) HIGH-STRENGTH STEEL WIRE MATERIAL EXHIBITING EXCELLENT COLD-DRAWING PROPERTIES, AND HIGH-STRENGTH STEEL WIRE

(71) Applicant: KOBE STEEL, LTD., Kobe-shi (JP)

(72) Inventors: Tomonobu Ishida, Kobe (JP); Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/767,208

(22) PCT Filed: Mar. 25, 2014

(86) PCT No.: PCT/JP2014/058167
§ 371 (c)(1),
(2) Date: Aug. 11, 2015

(87) PCT Pub. No.: WO2014/157129
PCT Pub. Date: Oct. 2, 2014

(65) Prior Publication Data

US 2016/0002755 A1 Jan. 7, 2016

(30) Foreign Application Priority Data

Mar. 28, 2013 (JP) ..... 2013-070373

(51) Int. Cl.
*C22C 38/32* (2006.01)
*C22C 38/28* (2006.01)
(Continued)

(52) U.S. Cl.
CPC ..... *C22C 38/32* (2013.01); *C21D 8/065* (2013.01); *C22C 38/00* (2013.01); *C22C 38/001* (2013.01);
(Continued)

(58) Field of Classification Search
CPC ..... C22C 38/06; C22C 38/54; C22C 38/001; C22C 38/002; C22C 38/20; C22C 38/02; C22C 38/04; C22C 38/08; C22C 38/10; C22C 38/22; C22C 38/12; C22C 38/14; C22C 38/16; C22C 38/26; C22C 38/24; C22C 38/30; C22C 38/32; C22C 38/34; C22C 38/28; C22C 38/00; C22C 38/105; C22C 38/18; C22C 38/40; C22C 38/42; C22C 38/44; C22C 2200/00; C22C 2200/06; C22C 2200/04; C22C 38/46; C22C 38/48; C22C 38/50; C22C 38/52; C23C 2/02; C23C 2/38; C23C 2/06; C23C 2/04; C23C 2/12; Y10T 428/12757; Y10T 428/12799; Y10T 428/12972; Y10T 428/12979
See application file for complete search history.

(56) References Cited

U.S. PATENT DOCUMENTS

2004/0118486 A1 6/2004 Zelin et al.
2006/0048864 A1* 3/2006 Nagao ..... C21D 8/06 148/320

(Continued)

FOREIGN PATENT DOCUMENTS

CN 1685072 A 10/2005
JP 04-289128 A 10/1992

(Continued)

OTHER PUBLICATIONS

Machine Translation, Tetsuo et al., JP 2003-321742, Nov. 2003.*

(Continued)

*Primary Examiner* — Michael E La Villa
(74) *Attorney, Agent, or Firm* — Oblon, McClelland, Maier & Neustadt, L.L.P.

(57) ABSTRACT

A technique with which air blast cooling can be used to produce a high-strength steel wire material that achieves
(Continued)

uniform high strength and high ductility, even when cold drawn; a high-strength steel wire produced from this high-strength steel wire material; and a zinc-plated high-strength steel wire. This high-strength steel wire material includes 0.80-1.3% of C, 0.1-1.5% of Si, 0.1-1.5% of Mn, more than 0% but not more than 0.03% of P, more than 0% but not more than 0.03% of S, 0.0005-0.01% of B, 0.01-0.10% of Al, and 0.001-0.006% of N, the remainder being iron and unavoidable impurities. The area ratio of pearlite in the structure of the high-strength steel wire material is at least 90%. The average grain size number ($P_{ave}$) of pearlite nodules and the standard deviation (Pσ) thereof respectively satisfy formula (1), namely $7.0 \leq P_{ave} \leq 10.0$, and formula (2), namely $P\sigma \leq 0.6$.

6 Claims, 1 Drawing Sheet

(51) Int. Cl.

| | |
|---|---|
| ***C22C 38/26*** | (2006.01) |
| ***C22C 38/24*** | (2006.01) |
| ***C22C 38/22*** | (2006.01) |
| ***C22C 38/16*** | (2006.01) |
| ***C22C 38/14*** | (2006.01) |
| ***C22C 38/30*** | (2006.01) |
| ***C22C 38/12*** | (2006.01) |
| ***C22C 38/10*** | (2006.01) |
| ***C23C 2/02*** | (2006.01) |
| ***E01D 19/16*** | (2006.01) |
| ***C22C 38/00*** | (2006.01) |
| ***C22C 38/06*** | (2006.01) |
| ***C22C 38/54*** | (2006.01) |
| ***C22C 38/02*** | (2006.01) |
| ***C22C 38/04*** | (2006.01) |
| ***C22C 38/08*** | (2006.01) |
| ***C23C 2/38*** | (2006.01) |
| *C21D 8/06* | (2006.01) |
| *C21D 9/00* | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/30* (2013.01); *C22C 38/54* (2013.01); *C23C 2/02* (2013.01); *C23C 2/38* (2013.01); *E01D 19/16* (2013.01); *C21D 8/06* (2013.01); *C21D 9/0075* (2013.01); *C21D 2211/009* (2013.01); *Y10T 428/12757* (2015.01); *Y10T 428/12799* (2015.01); *Y10T 428/12972* (2015.01); *Y10T 428/12979* (2015.01)

(56) References Cited

U.S. PATENT DOCUMENTS

| | | | | |
|---|---|---|---|---|
| 2009/0087336 | A1 | 4/2009 | Nishida et al. | |
| 2009/0277545 | A1* | 11/2009 | Yamasaki | C21D 8/065 148/598 |
| 2010/0212786 | A1 | 8/2010 | Yamasaki et al. | |
| 2011/0284139 | A1 | 11/2011 | Nishida et al. | |
| 2013/0127100 | A1* | 5/2013 | Ishida | C21D 8/06 267/166 |

FOREIGN PATENT DOCUMENTS

| | | | |
|---|---|---|---|
| JP | 05-287451 | A | 11/1993 |
| JP | 11-315349 | A | 11/1999 |
| JP | 2000-337333 | A | 12/2000 |
| JP | 2001-181789 | A | 7/2001 |
| JP | 2001-192771 | A | 7/2001 |
| JP | 2003-321742 | A | 11/2003 |
| JP | 2005-232549 | A | 9/2005 |
| JP | 2007-131944 | A | 5/2007 |
| JP | 2007-131945 | A | 5/2007 |
| JP | 2012-072492 | | 4/2012 |
| JP | 2012-233254 | A | 11/2012 |
| KR | 10-0636958 | B | 10/2006 |
| WO | 2007/139234 | | 12/2007 |
| WO | WO 2012/029812 | * | 3/2012 |

OTHER PUBLICATIONS

Machine Translation, Makoto et al., JP 2001-192771, Jul. 2001.*
Machine Translation, Yuichi et al., JP 2000-337333, Dec. 2000.*
Matthew Peet, "ASTM grain size," downloaded from www.matthewpeet.org on Mar. 4, 2014, no date (two pages).*
International Search Report and Written Opinion issued on Jun. 17, 2014 for PCT/JP2014/058167 filed on Mar. 25, 2014.

* cited by examiner

HIGH-STRENGTH STEEL WIRE MATERIAL EXHIBITING EXCELLENT COLD-DRAWING PROPERTIES, AND HIGH-STRENGTH STEEL WIRE

TECHNICAL FIELD

The present invention relates to a high-strength steel wire that is useful as a material for a galvanized steel wire for use in a rope for a bridge or the like, and a high-strength steel wire rod to produce such a high-strength steel wire. In particular, the invention relates to a high-strength steel wire rod having good workability for wire-drawing without heat treatment after rolling.

BACKGROUND ART

A steel wire subjected to hot-dip galvanization for higher corrosion resistance, or a galvanized steel wire strand as a strand of such steel wires is used as a rope for use in a bridge. As a material for such a steel wire, for example, JIS G 3548 describes a steel wire having a wire diameter of 5 mm and a tensile strength TS of about 1500 to 1700 MPa. A carbon steel described in JIS G 3506 is mainly used as a material steel for the steel wire.

A steel wire as a material for the hot-dip galvanized steel wire is required to be reduced in manufacturing cost and to have higher strength. Higher strength advantageously reduces steel usage and improves the degree of freedom of bridge design.

The galvanized steel wire is typically manufactured in the following manner. First, a wire rod (steel wire rod) fabricated through hot rolling is placed in a ring shape on a cooling conveyer for pearlite transformation, and is then wound up into a coil to yield a wire rod coil. Subsequently, the wire rod coil is subjected to patenting treatment so as to have higher strength and a homogenous microstructure. The patenting treatment is a type of heat treatment, in which a wire rod is typically heated to about 950° C. using a continuous furnace and austenized, and is then dipped in a refrigerant such as a lead bath maintained at about 500° C. to produce a fine and homogeneous pearlite phase.

Subsequently, the wire rod is subjected to cold wire-drawing, so that a steel wire having a predetermined strength is produced by the effect of a work hardening function of pearlite steel. Subsequently, the steel wire is dipped in a galvanizing bath maintained at about 450° C. for galvanization, so that a galvanized steel wire is produced. The galvanized steel wire may be further subjected to finish drawing. A parallel wire strand (PWS) as a bundle of galvanized steel wires produced in such a way or a galvanized steel wire strand as a strand of such steel wires is used to produce a cable for a bridge.

In such a series of manufacturing steps, the patenting treatment causes an increase in manufacturing cost. Although the patenting treatment is effective in increasing strength of a wire rod and homogenizing quality thereof, the patenting treatment increases manufacturing cost, and has environmental problems such as $CO_2$ emission and use of an environment-load substance. The hot-rolled wire rod could be advantageously drawn to be formed into a steel wire product without heat treatment such as the patenting treatment. Drawing the hot-rolled wire rod without heat treatment is generally called "rod drawing".

A variation in strength in a longitudinal direction of the rod-drawn wire rod is an issue in achieving a high-strength rod-drawn wire rod. In a typical manufacturing process of a wire rod with air blast cooling, the wire rod is cooled while being placed in a ring shape on a cooling conveyer. FIG. 1 is a schematic illustration of a state of the ring-shaped wire rod on the cooling conveyer. Cooling the wire rod in such a state causes a portion of a dense part 10 in which portions of the wire rod lie relatively dense, and a portion of a sparse part 11 in which portions of the wire rod lie relatively sparsely.

As a result, cooling rate varies between the dense part 10 and the sparse part 11, and the precipitating pearlite phase has a periodic variation corresponding to a circumference of a ring; hence, the mechanical properties of the wire rod also have a periodic variation. When a wire rod has a variation in strength, product strength is designed with reference to the lower limit of the strength of the wire rod on the safety grounds. Hence, decreasing a variation in strength of the wire rod enables design of a product having higher strength. A rod-drawn wire rod does not get the benefit of homogenizing a microstructure by patenting treatment. Hence, the microstructure of such a wire rod must be homogenized through microstructure control after hot rolling to decrease the variation in strength.

There have been provided various techniques for improving wire-drawability. For example, PTL 1 provides a technique for improving wire-drawability through cooling in a molten salt bath after hot rolling. Such a technique is called direct patenting treatment.

PTL 2 discloses a technique for increasing strength of a wire rod by controlling a cooling condition after hot rolling so that the patenting treatment is omitted.

PTL 3 discloses a technique for improving wire-drawability of a spring-steel wire rod by decreasing a variation in pearlite phase depending on coil density.

CITATION LIST

Patent Literature

PTL 1: Japanese Unexamined Patent Application Publication No. Hei 4(1992)-289128.

PTL 2: Japanese Unexamined Patent Application Publication No. Hei 5(1993)-287451.

PTL 3: Japanese Unexamined Patent Application Publication No. 2012-72492.

SUMMARY OF INVENTION

Technical Problem

However, the direct patenting treatment using the molten salt bath is high in manufacturing cost and low in equipment maintainability compared with air blast cooling. In addition, wire-drawability of the produced steel is low, about 80% in area reduction ratio, and a strength level of the wire (steel wire) is only about 180 to 190 kgf/mm$^2$ (1764 to 1862 MPa).

For the steel produced by the technique disclosed in PTL 2, wire-drawability is low, about 50% in area reduction ratio, and a strength level of the wire (steel wire) is also low, about 1350 to 1500 MPa.

The technique of PTL 3 does not consider toughness evaluated by torsion characteristics or the like, and does not necessarily satisfy the specification for the torsion characteristics required for ropes as defined in JIS G 3625 or JIS G 1784.

An object of the invention, which has been achieved in light of such circumstances, is to provide a technique for producing a high-strength steel wire rod, which has homogenous quality, high strength, and high toughness even after rod drawing, by air blast cooling having good productivity, and a high-strength steel wire produced from such a high-strength steel wire rod, and a high-strength galvanized steel wire.

Solution to Problem

The high-strength steel wire rod of the invention, by which the above-described object is achieved, contains C: 0.80 to 1.3% (by mass percent (the same applies to the following for the components)), Si: 0.1 to 1.5%, Mn: 0.1 to 1.5%, P: more than 0% and 0.03% or less, S: more than 0% and 0.03% or less, B: 0.0005 to 0.01%, Al: 0.01 to 0.10%, and N: 0.001 to 0.006%, the remainder consisting of iron and inevitable impurities, where, in the microstructure of the steel wire rod, an area ratio of pearlite is 90% or more, and an average $P_{ave}$ and standard deviation Pσ of a pearlite nodule size number satisfy Formulas (1) and (2), respectively, $$7.0 \leq P_{ave} \leq 10.0 \quad (1),$$

$$P\sigma \leq 0.6 \quad (2).$$

In the high-strength steel wire rod of the invention, an area ratio of grain-boundary ferrite grains is preferably 1.0% or less.

Furthermore, in the high-strength steel wire rod of the invention, $C_{eq}$ is preferably 0.85 to 1.45%, the $C_{eq}$ being represented by Formula (3)

$$C_{eq}=[C]+[Si]/24+[Mn]/6+[Ni]/40+[Cr]/5+[Mo]/4+[V]/14 \quad (3)$$

where [C], [Si], [Mn], [Ni], [Cr], [Mo], and [V] represent the respective contents (by mass percent) of C, Si, Mn, Ni, Cr, MO, and V.

The chemical composition of the high-strength steel wire rod further effectively contains, as necessary, at least one of elements including (a) Cr: more than 0% and 0.5% or less, (b) V: more than 0% and 0.2% or less, (c) at least one element selected from the group consisting of Ti: more than 0% and 0.2% or less and Nb: more than 0% and 0.5% or less, (d) at least one element selected from the group consisting of W: more than 0% and 0.5% or less and Co: more than 0% and 1.0% or less, (e) Ni: more than 0% and 0.5% or less, and (f) at least one element selected from the group consisting of Cu: more than 0% and 0.5% or less and Mo: more than 0% and 0.5% or less. The properties of the high-strength steel wire rod are further improved depending on a type of the element to be contained.

The invention also includes a high-strength steel wire produced through wire-drawing, for example, a drawing process, of the high-strength steel wire rod as described above. In a high-strength galvanized steel wire produced by performing hot-dip galvanization on the high-strength steel wire, the standard deviation WTSσ of tensile strength TS satisfies Formula (4)

$$WTS\sigma \leq 40 \text{ (MPa)} \quad (4).$$

Advantageous Effects of Invention

According to the invention, the chemical composition is strictly defined, and the microstructure is designed such that an area ratio of pearlite is 90% or more, and the average $P_{ave}$ and the standard deviation Pσ of the size number of the pearlite nodule are each within a predetermined range. This achieves a high-strength steel wire rod having homogenous quality, high strength, and high toughness even after rod drawing. The steel wire produced from such a high-strength steel wire rod is greatly useful as a material for a hot-dip galvanized steel wire or a steel wire strand as a material for a rope for use in a bridge and the like.

DESCRIPTION OF EMBODIMENTS

Figure 1:
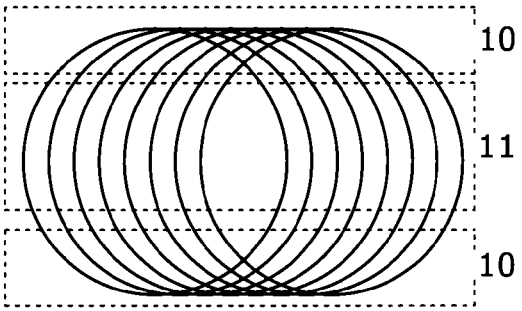
FIG. 1 is a schematic illustration of a state of a ring-shaped wire rod on a cooling conveyer.

The inventors have made earnest study particularly on transformation behavior of carbon steel to provide a homogenous wire rod having a reduced variation in microstructure even after rod drawing. As a result, the inventors have found that, even in hypereutectoid steel, a fine ferrite phase precipitates in a grain boundary, i.e., grain-boundary ferrite grains precipitate prior to pearlite transformation, and cooling rate locally varies due to transformation heat generated during such precipitation, resulting in a variation in microstructure. Specifically, they have found that precipitation of the grain-boundary ferrite grains prompts a variation in pearlite phase, and the variation in pearlite phase can be reduced by suppressing the precipitation amount of the grain-boundary ferrite grains.

Adding B is particularly effective in suppressing the precipitation of the grain-boundary ferrite grains. B segregates in an austenite grain boundary and reduces grain boundary energy, and thus exhibits an effect of suppressing precipitation of grain-boundary ferrite grains from grain boundaries. If B precipitates in a form of a compound such as BN, such an effect is not exhibited. Hence, B has been importantly dissolved in steel in a stage of pearlite transformation.

To reduce a variation in microstructure, it is also important to appropriately design hardenability of a wire rod after hot rolling, i.e., appropriately design time before start of pearlite transformation (transformation start time) and time from start to end of the transformation (transformation time). Since the transformation start time is greatly affected by austenite grain size before transformation, the austenite grain size is preferably reduced by increasing an area reduction ratio in hot rolling (specifically, by controlling area reduction strain ϵ to be 0.4 or more as described later), for example. The transformation start time becomes shorter as the crystal grain size is smaller, i.e., longer as the grain size is larger. The coil is cooled at a rate that varies depending on coil density. Hence, shorter transformation start time reduces a difference in transformation temperature, leading to a decrease in variation in microstructure.

On the other hand, longer transformation time makes the transformation temperature uniform by the recuperative effect due to transformation heating, and thus allows the variation in microstructure to be reduced. Alloy composition including C (carbon) has a significant influence on control of the transformation time. Such influence can be represented using the carbon equivalent $C_{eq}$ defined by Formula (3). Increasing the carbon equivalent $C_{eq}$ lengthens the transformation time, leading to a decrease in variation in microstructure. However, if the carbon equivalent $C_{eq}$ is excessively increased, time for controlling the microstructure is lengthened, and transformation is not completed on a conveyer, which prevents appropriate microstructure control. From such a point, the carbon equivalent $C_{eq}$ is preferably controlled to be 0.85 to 1.45%. A more preferred lower limit of the carbon equivalent $C_{eq}$ is 0.90% or more. The upper limit thereof is preferably 1.40% or less, and more preferably 1.35% or less.

$$C_{eq}=[C]+[Si]/24+[Mn]/6+[Ni]/40+[Cr]/5+[Mo]/4+[V]/14 \quad (3)$$

where [C], [Si], [Mn], [Ni], [Cr], [Mo], and [V] represent the respective contents (by mass percent) of C, Si, Mn, Ni, Cr, MO, and V.

The steel wire rod of the invention must be appropriately controlled in microstructure and must be appropriately adjusted in chemical composition. From such a point, the reason for determining the range of each chemical component of the wire rod is as follows.

(C: 0.80 to 1.3%)

C is an element that is effective in increasing strength. Increased C content increases strength of a cold-rolled steel wire. The C content must be 0.80% or more to ensure the target strength level of the invention. However, if the C content is excessive, proeutectoid cementite is precipitated in grain boundaries, which impairs wire-drawability. From such a point, the C content must be 1.3% or less. The lower limit of the C content is preferably 0.82% or more, and more preferably 0.84% or more. The upper limit thereof is preferably 1.2% or less, and more preferably 1.1% or less.

(Si; 0.1 to 1.5%)

Si is an effective deoxidizer, and exhibits an effect of decreasing the amount of oxide-based inclusion in steel. In addition, Si increases strength of the wire rod, and exhibits an effect of suppressing cementite granulation along with thermal history during hot-dip galvanization, and thus suppressing a reduction in strength. Si must be contained 0.1% or more so as to effectively exhibit such effects. However, an excessive Si content degrades toughness of the wire rod; hence, the Si content must be 1.5% or less. The lower limit of the Si content is preferably 0.15% or more, and more preferably 0.20% or more. The upper limit thereof is preferably 1.4% or less, and more preferably 1.3% or less.

(Mn; 0.1 to 1.5%)

Mn greatly improves hardenability of steel, and thus exhibits an effect of lowering a transformation temperature during air blast cooling, and increasing strength of a pearlite phase. Mn must be contained 0.1% or more so as to effectively exhibit such effects. However, Mn is an element that is easily segregated, and if Mn is excessively contained, hardenability of a portion, in which Mn is segregated, is excessively enhanced, and a supercooled phase such as martensite may be formed. In consideration of such influences, the upper limit of the Mn content is 1.5% or less. The lower limit of the Mn content is preferably 0.2% or more, and more preferably 0.3% or more. The upper limit thereof is preferably 1.4% or less, and more preferably 1.3% or less.

(P: more than 0% and 0.03% or less, S: more than 0% and 0.03% or less)

P and S are each segregated in prior austenite grain boundaries and thus make the grain boundaries brittle, leading to a degradation in fatigue characteristics. It is therefore basically preferred that the content of each of P and S is as low as possible, but the upper limit of the content is defined to be 0.03% or less in terms of industrial production. Each content is preferably 0.02% or less, and more preferably 0.01% or less. P and S are each an impurity that is inevitably contained in steel, and it is difficult to decrease the content thereof to 0% in terms of industrial production.

(B: 0.005% to 0.01%)

B hinders formation of grain-boundary ferrite grains, and thus exhibits an effect of allowing a microstructure to be easily controlled into a homogeneous pearlite phase. In addition, adding a small amount of B greatly enhances hardenability, and thus increases strength of the wire rod at low cost. B (total B) must be contained 0.0005% or more so as to effectively exhibit such functions. B in a form of a compound such as BN does not exhibit such effects. Hence, not only B in steel (total B), but also B in a form of dissolved B should be defined to be contained preferably 0.0003% or more, and more preferably 0.0005% or more. However, if the content of B (total B) is excessive, a compound with iron (B-constituent) precipitates, which induces cracking during hot rolling; hence, the upper limit of the B content must be 0.01% or less. The lower limit of the B content is more preferably 0.0008% or more, and further preferably 0.0001% or more. The upper limit thereof is more preferably 0.008% or less, and further preferably 0.006% or less.

(Al: 0.01 to 0.10%)

Al has a strong deoxidizing function, and exhibits an effect of decreasing the amount of oxide-based inclusion in steel. Moreover, Al forms nitride such as AlN, and thus exhibits an effect of suppressing precipitation of BN and increasing the amount of dissolved B. Furthermore, Al promisingly exhibits an effect of refining crystal grains by a pinning function of the nitride and an effect of decreasing the amount of dissolved N. Al must be contained 0.01% or more so as to exhibit such effects. However, if the Al content is excessive, the amount of Al-based inclusion such as $Al_2O_3$ increases, causing a bad effect such as an increase in wire breaking rate during wire-drawing. The Al content must be 0.10% or less in order to prevent such a bad effect. The lower limit of the Al content is preferably 0.02% or more, and more preferably 0.03% or more. The upper limit thereof is preferably 0.08% or less, and more preferably 0.06% or less.

(N: 0.001 to 0.006%)

N is dissolved in steel as an interstitial element and induces embrittlement due to strain aging, which degrades toughness of the wire rod. The upper limit of the N content (total N) in steel is therefore 0.006% or less. However, such a disadvantage is provided only by dissolved N that is dissolved in steel. A nitrogen precipitate that is precipitated in a form of nitride, i.e., N in compounds has no bad influence on toughness. Hence, the amount of dissolved N that is dissolved in steel is desirably controlled separately from N in steel (total N). The amount of dissolved N is preferably 0.0005% or less, and more preferably 0.0003% or less. On the other hand, it is difficult to decrease the amount of dissolved N in steel to less than 0.001% in terms of industrial production; hence, the lower limit of the N content in steel is 0.001% or more. The upper limit of the N content in steel is preferably 0.004% or less, and more preferably 0.003% or less.

The components defined in the invention are as described above. The remainder consists of iron and inevitable impurities. The inevitable impurities may include elements that are introduced depending on starting materials, other materials, and situations of production facilities, etc.

The chemical composition further effectively contains the following elements singly or in appropriate combination as necessary: (a) Cr: more than 0% and 0.5% or less, (b) V: more than 0% and 0.2% or less, (c) at least one element selected from the group consisting of Ti: more than 0% and 0.2% or less and Nb: more than 0% and 0.5% or less, (d) at least one element selected from the group consisting of W: more than 0% and 0.5% or less and Co: more than 0% and 1.0% or less, (e) Ni: more than 0% and 0.5% or less, and (f) at least one element selected from the group consisting of Cu: more than 0% and 0.5% or less and Mo: more than 0% and 0.5% or less. The properties of the wire rod are further improved depending on a type of the element to be contained. The reason for defining the range of each of the elements to be contained is as follows.

(a) (Cr: more than 0% and 0.5% or less)

Cr reduces the lamellar spacing of pearlite, and thus exhibits an effect of improving strength or toughness of the wire rod. In addition, as with Si, Cr exhibits an effect of suppressing reduction in strength of the wire rod during galvanization. However, when the Cr content is excessive, the effects wastefully reach saturation; hence, the Cr content is preferably 0.5% or less. The Cr content is preferably 0.001% or more and more preferably 0.05% or more so that the effects of Cr are effectively exhibited. The upper limit of the Cr content is more preferably 0.4% or less, and further preferably 0.3% or less.

(b) (V: more than 0% and 0.2% or less)

V forms fine carbide/nitride (carbide, nitride, and carbonitride) and thus exhibits an effect of increasing strength and an effect of refining crystal grains. In addition, V fixes dissolved N and thus promisingly exhibits an effect of suppressing aging embrittlement. V is contained preferably 0.001% or more and more preferably 0.05% or more so as to effectively exhibit such effects. However, when the V content is excessive, the effects wastefully reach saturation; hence, the V content is preferably 0.2% or less. The V content is more preferably 0.18% or less, and further preferably 0.15% or less.

(c) (At least one element selected from the group consisting of Ti: more than 0% and 0.2% or less and Nb: more than 0% and 0.5% or less)

Ti is a stronger nitride formation element than Al or V, and thus exhibits an effect of increasing the amount of dissolved B, an effect of refining crystal grains, and an effect of decreasing the amount of dissolved N. Ti is contained preferably 0.02% or more, more preferably 0.03% or more, and further preferably 0.04% or more so as to exhibit such effects. However, if the Ti content is excessive, Ti oxide precipitates, causing a bad effect such as an increase in wire breaking rate during wire-drawing. From such a point, the Ti content is preferably 0.2% or less. The upper limit of the Ti content is preferably 0.18% or less, and more preferably 0.16% or less.

As with Ti, Nb forms nitride and thus contributes to refining crystal grains. In addition, Nb fixes dissolved N and thus promisingly suppresses aging embrittlement. Nb is contained preferably 0.01% or more, more preferably 0.02% or more, and further preferably 0.03% or more so as to exhibit such effects. However, when the Nb content is excessive, the effects wastefully reaches saturation. Hence, the Nb content is preferably 0.5% or less. The upper limit of the Nb content is more preferably 0.4% or less, and further preferably 0.3% or less.

(d) (At least one element selected from the group consisting of W: more than 0% and 0.5% or less and Co: more than 0% and 1.0% or less)

W and Co are each an element that is effective in decreasing a variation in microstructure. In detail, W enhances hardenability and lengthens the transformation start time, and thus exhibits an effect of decreasing the variation in microstructure. W is contained preferably 0.005% or more and more preferably 0.007% or more so as to effectively exhibit the effect. However, when W, an expensive element, is excessively contained, the effect wastefully reaches saturation. Hence, the W content is preferably 0.5% or less. The W content is more preferably 0.4% or less, and further preferably 0.3% or less.

Co exhibits an effect of decreasing the variation in microstructure, and exhibits an effect of decreasing the amount of proeutectoid cementite and allowing a microstructure to be easily controlled into a homogeneous pearlite phase. However, when Co is excessively contained, the effect wastefully reaches saturation. Hence, the upper limit of the Co content is preferably 1.0% or less. The upper limit is more preferably 0.8% or less, and further preferably 0.5% or less. Co is contained preferably 0.05% or more, more preferably 0.1% or more, and further preferably 0.2% or more so as to effectively exhibit the effect.

(e) (Ni: more than 0% and 0.5% or less)

Ni is an element that is effective in improving toughness of the steel wire after wire-drawing. Ni is contained preferably 0.05% or more and more preferably 0.1% or more so as to effectively exhibit the effect. However, when the Ni content is excessive, the effect wastefully reaches saturation; hence, the Ni content is preferably 0.5% or less. The Ni content is more preferably 0.4% or less, and further preferably 0.3% or less.

(f) (At least one element selected from the group consisting of Cu: more than 0% and 0.5% or less and Mo: more than 0% and 0.5% or less)

Cu and Mo are each an element that is effective in improving corrosion resistance of the steel wire. Cu and Mo are each contained preferably 0.05% or more and more preferably 0.1% or more so as to effectively exhibit such an effect. However, if the Cu content is excessive, Cu reacts with S and forms CuS that segregates in a grain boundary, causing flaws during wire rod manufacturing. Hence, the upper limit of the Cu content is preferably 0.5% or less. The upper limit thereof is more preferably 0.4% or less, and further preferably 0.3% or less.

If the Mo content is excessive, a supercooled phase is readily formed during hot rolling, and ductility is degraded. Consequently, the upper limit of the Mo content is preferably 0.5% or less. The upper limit thereof is more preferably 0.4% or less, and further preferably 0.3% or less.

The microstructure of the high-strength steel wire rod of the invention mainly includes pearlite, for example, in an area ratio of 90% or more. The percentage of pearlite is preferably at least 92 percent by area, and more preferably at least 95 percent by area within a range without hindering the functions of the invention. However, another phase, for example, proeutectoid ferrite or bainite, is allowed to be contained less than 10 percent by area.

In the high-strength steel wire rod of the invention, the average $P_{ave}$ and the standard deviation $P\sigma$ of the size number of the pearlite nodule satisfy Formulas (1) and (2), respectively, $$7.0 \leq P_{ave} \leq 10.0 \quad (1),$$

$$P\sigma \leq 0.6 \quad (2).$$

The reason for defining such requirements is described below.

The high-strength steel wire rod of the invention is achieved in light of decreasing a periodic variation in pearlite phase depending on coil density, the variation being in a longitudinal direction of the wire rod. For longitudinal distribution of the size number of the pearlite nodule, the average of the size number is denoted as $P_{ave}$, and the standard deviation thereof is denoted as $P\sigma$. Here, the standard deviation $P\sigma$ must be 0.6 or less. When the standard deviation $P\sigma$ is larger than 0.6, a variation in strength of the wire rod or a variation in strength (steel wire strength) of a wire after wire-drawing increases. In some case, a portion having low wire-drawability is locally shown, and the portion is degraded in toughness during wire-drawing, leading to occurrence of a longitudinal crack. The standard deviation Pσ is preferably 0.5 or less, and more preferably 0.4 or less.

If the average $P_{ave}$ of the size number of the pearlite nodule is excessively small, i.e., if the crystal grain size is large, the wire rod has insufficient ductility, resulting in degradation in wire-drawability. When the average $P_{ave}$ is excessively large, i.e., when the crystal grain size is small, hardness of the wire rod increases and wire-drawability is degraded, causing a wire braking or dice seizing. If the average $P_{ave}$ is excessively large, a bainite phase may be partially formed, which also causes an increase in the number of wire breaking. From such a point, the average $P_{ave}$ must be 7.0 to 10.0. The lower limit of the average $P_{ave}$ is preferably 7.5 or more, and more preferably 8.0 or more. The upper limit thereof is preferably 9.5 or less, and more preferably 9.0 or less.

The high-strength steel wire rod of the invention can satisfy the requirements as described above by decreasing the amount of the grain-boundary ferrite grains. From such a point, the area ratio of the grain-boundary ferrite grains is preferably 1.0% or less. The area ratio of the grain-boundary ferrite grains is more preferably 0.9% or less, and further preferably 0.6% or less. A smaller amount of the grain-boundary ferrite grains provides a better effect. However, when the amount of the grain-boundary ferrite grains is decreased to a certain level or lower, such an effect reaches saturation. Hence, the area ratio of the grain-boundary ferrite grains is industrially preferably 0.1% or more, and more preferably 0.2% or more.

The high-strength steel wire rod of the invention should be manufactured according to a usual manufacturing condition while a billet having a chemical composition adjusted as described above is used. However, as described below, there is a preferred manufacturing condition to appropriately adjust the microstructure or the like of the wire rod.

In a typical manufacturing process of the high-carbon steel wire rod, a billet adjusted into a predetermined chemical composition is heated and austenized. The billet is then hot-rolled into a wire rod having a predetermined wire diameter, and is then cooled on a cooling conveyer, during which the austenite phase is transformed into a pearlite phase. In this process, a fine austenite phase is produced along with dynamic recrystallization during the hot rolling. As a specific measure to reduce the austenite grain size and shorten the transformation start time, the area reduction ratio in hot rolling should be set large. The last four passes (four passes from the last pass to the last pass but three) of hot rolling most greatly affect the crystal grain size. When an area reduction strain $\epsilon$ over the last four passes is adjusted to be 0.4 or more, austenite grains are sufficiently refined. This shortens the transformation start time, leading to a reduction in variation in pearlite phase. The area reduction strain $\epsilon$ is represented by $\epsilon=\ln(S_1/S_2)$, where $S_1$ represents cross section of a wire rod on an inlet side of a mill roll, and $S_2$ represents cross section of a wire rod on an outlet side thereof. The lower limit of the area reduction strain $\epsilon$ is preferably 0.42 or more, and more preferably 0.45 or more. The upper limit thereof is preferably 0.8 or less, and more preferably 0.6 or less.

Subsequently, placing temperature for placing the hot-rolled wire rod on a cooling conveyer is preferably 850 to 950° C. If the placing temperature exceeds 950° C., austenite grains are coarsened, due to which a pearlite phase having a large grain size precipitates during cooling. If the placing temperature is lower than 850° C., pearlite grain size is excessively reduced and hardness is increased. In addition, a supercooled phase such as bainite or martensite is easily formed. The upper limit of the placing temperature is more preferably 940° C. or lower, and further preferably 930° C. or lower. The lower limit of the placing temperature is more preferably 870° C. or higher, and further preferably 880° C. or higher.

The average cooling rate from the placing to 700° C. is preferably 5° C./sec or more and 20° C./sec or less. If the average cooling rate is low, pearlite grain size increases, and strength of the wire rod is lowered. Conversely, if the average cooling rate is too high, pearlite may be excessively refined, or the supercooled phase may be formed. The lower limit of the average cooling rate is more preferably 7° C./sec or more, and further preferably 10° C./sec or more. The upper limit thereof is more preferably 18° C./sec or less, and further preferably 15° C./sec or less.

The wire rod after hot rolling (hot-rolled wire rod) produced in this way has a predetermined strength and good rod drawability. The average tensile strength $TS_{ave}$, which is determined by a method as described later, of the hot-rolled wire rod is preferably 1200 MPa or more, and more preferably 1220 MPa or more. The standard deviation TSσ of the tensile strength is preferably 30 MPa or less, and more preferably 25 MPa or less.

For the reduction of area RA as a criterion for wire-drawability of the hot-rolled wire rod, the average ($RA_{ave}$), which is determined by a method as described later, is preferably 20% or more, and more preferably 24% or more. The standard deviation RAσ of the reduction of area RA is preferably 2.0% or less, and more preferably 1.8% or less.

Such a hot-rolled wire rod is subjected to wire-drawing, resulting in production of a high-strength steel wire that exhibits desired strength and torsion characteristics. Such a high-strength steel wire is typically used in a form of a high-strength galvanized steel wire that is produced by performing hot-dip galvanization on the surface of the high-strength steel wire. For the high-strength galvanized steel wire, the standard deviation WTSσ of tensile strength TS satisfies Formula (4)

$$WTS\sigma \leq 40 \text{ (MPa)} \quad (4).$$

When a variation in strength is large after the high-strength galvanized steel wire is formed, design strength of a rope must be lowered, and wire-drawability locally varies, resulting in increased percent defective of wire breaking. From such a point, the standard deviation WTSσ of strength distribution in a longitudinal direction of the wire is 40 MPa or less. The standard deviation WTSσ is preferably 35 MPa or less, and more preferably 30 MPa or less.

Although the invention is now described in detail with an example, the invention should not be limited thereto, and modifications or alterations thereof may be made within the scope without departing from the gist described before and later, all of which are included in the technical scope of the invention.

This application claims the benefit of Japanese Priority Patent Application JP 2013-70373 filed on Mar. 28, 2013, the entire contents of which are incorporated herein by reference.

EXAMPLE

Billets each having a cross section 155×155 mm, which had chemical compositions (steel types A to Z) listed in Table 1, were prepared. The billets were each formed into a predetermined wire diameter through hot rolling, placed in a ring shape on a cooling conveyer, subjected to control cooling with air blast cooling for pearlite transformation, and wound in a coil shape, so that hot-rolled wire rod coils were produced. In Table 1, "—" represents that the relevant element is not contained.

TABLE 1

| Steel type | Chemical composition * (mass %) C | Si | Mn | Al | P | S | N | B | Cr | V | Ti | Nb | W | Mo | Cu | Co | Ni | Ceq (mass %) |
|---|---|---|---|---|---|---|---|---|---|---|---|---|---|---|---|---|---|---|
| A | 1.05 | 0.40 | 0.30 | 0.04 | 0.010 | 0.010 | 0.0042 | 0.0020 | — | — | — | — | — | — | — | — | — | 1.12 |
| B | 0.92 | 0.90 | 0.50 | 0.04 | 0.011 | 0.006 | 0.0037 | 0.0025 | — | — | 0.03 | — | — | — | — | — | — | 1.04 |
| C | 0.98 | 0.60 | 0.70 | 0.03 | 0.008 | 0.008 | 0.0053 | 0.0012 | 0.15 | — | — | 0.07 | — | — | — | — | — | 1.15 |
| D | 0.88 | 0.60 | 0.70 | 0.03 | 0.010 | 0.010 | 0.0044 | 0.0015 | 0.20 | — | — | — | — | — | — | — | — | 1.06 |
| E | 1.05 | 0.70 | 0.85 | 0.07 | 0.010 | 0.011 | 0.0032 | 0.0030 | — | 0.07 | 0.08 | — | — | — | — | — | — | 1.23 |
| F | 0.97 | 0.62 | 0.51 | 0.06 | 0.007 | 0.010 | 0.0046 | 0.0020 | — | — | — | — | — | — | — | — | — | 1.08 |
| G | 0.84 | 0.43 | 1.20 | 0.04 | 0.010 | 0.020 | 0.0051 | 0.0050 | — | — | — | — | 0.10 | — | — | — | — | 1.06 |
| H | 1.02 | 0.60 | 0.70 | 0.03 | 0.020 | 0.008 | 0.0048 | 0.0022 | 0.20 | — | 0.07 | — | — | — | — | — | — | 1.20 |
| I | 0.90 | 0.50 | 0.81 | 0.09 | 0.007 | 0.010 | 0.0052 | 0.0024 | — | — | 0.05 | — | — | — | 0.07 | — | — | 1.06 |
| J | 1.20 | 0.40 | 0.60 | 0.05 | 0.008 | 0.012 | 0.0031 | 0.0018 | — | — | — | — | — | — | — | — | 0.20 | 1.32 |
| K | 0.85 | 0.24 | 0.61 | 0.02 | 0.006 | 0.008 | 0.0042 | 0.0015 | 0.15 | 0.2 | — | — | — | — | — | 0.20 | — | 1.01 |
| L | 1.30 | 0.69 | 0.51 | 0.08 | 0.010 | 0.007 | 0.0058 | 0.0022 | 0.20 | — | — | 0.21 | — | — | — | — | — | 1.45 |
| M | 0.80 | 0.25 | 0.50 | 0.02 | 0.015 | 0.011 | 0.0036 | 0.0012 | — | — | 0.06 | — | — | — | — | — | — | 0.89 |
| N | 0.87 | 1.43 | 1.50 | 0.03 | 0.010 | 0.010 | 0.0052 | 0.0002 | — | — | — | — | — | 0.20 | — | — | — | 1.23 |
| O | 1.10 | 0.20 | 0.80 | 0.02 | 0.008 | 0.013 | 0.0047 | 0.0013 | 0.30 | — | — | — | — | — | — | 0.70 | — | 1.30 |
| P | 0.72 | 0.39 | 0.68 | 0.07 | 0.010 | 0.010 | 0.0018 | 0.0031 | — | — | — | — | — | — | — | — | — | 0.85 |
| Q | 1.40 | 0.40 | 0.58 | 0.06 | 0.008 | 0.011 | 0.0037 | 0.0026 | — | — | 0.10 | — | — | — | — | — | — | 1.51 |
| R | 1.10 | 1.21 | 1.40 | 0.05 | 0.008 | 0.011 | 0.0044 | 0.0019 | 0.20 | 0.1 | — | — | — | 0.10 | — | — | — | 1.46 |
| S | 0.80 | 0.20 | 0.20 | 0.02 | 0.008 | 0.010 | 0.0053 | 0.0016 | — | — | — | — | — | — | — | — | — | 0.84 |
| T | 1.02 | 0.40 | 0.70 | 0.03 | 0.008 | 0.008 | 0.0053 | 0.0022 | — | — | — | — | — | — | — | — | — | 1.15 |
| U | 0.99 | 0.25 | 0.50 | 0.02 | 0.009 | 0.010 | 0.0044 | 0.0016 | 0.25 | — | — | — | — | — | — | — | — | 1.13 |
| V | 0.87 | 0.30 | 0.50 | 0.03 | 0.010 | 0.009 | 0.0061 | 0.0011 | — | 0.06 | — | — | — | — | — | — | — | 0.97 |
| X | 0.89 | 0.20 | 0.60 | 0.04 | 0.006 | 0.007 | 0.0055 | 0.0027 | — | — | — | 0.10 | — | — | — | — | — | 1.00 |
| Y | 0.94 | 0.40 | 0.70 | 0.05 | 0.012 | 0.011 | 0.0031 | 0.0031 | — | — | — | — | — | — | 0.05 | — | — | 1.07 |
| Z | 0.91 | 0.50 | 0.70 | 0.03 | 0.008 | 0.010 | 0.0037 | 0.0022 | — | — | — | — | — | — | — | 0.30 | — | 1.05 |

* The remainder: iron and inevitable impurities other than P and S

Table 2 shows the manufacturing conditions of the hot-rolled wire rod coils. In Table 2, "heating temperature" represents furnace temperature before hot rolling, and "area reduction strain ϵ" represents the total area reduction strain over the last four passes (four passes in total from the last pass to the last pass but three) of hot rolling. In addition, "average cooling rate" represents an average cooling rate from placing the dense part of the coil to 700° C. While the temperature was measured using a radiation thermometer, temperature of the sparse part of the coil was not accurately measured because the wire rod was open in the sparse part.

TABLE 2

| Test No. | Steel type | Hot-rolling condition: Heating temperature (° C.) | Area reduction strain ϵ * (—) | Placing temperature (° C.) | Cooling rate (° C./sec) | Hot-rolled wire rod: Wire diameter of hot-rolled wire rod (mm) | Pave | Pσ | Grain boundary α (area %) | Hardness (HV) | Dissolved B (mass %) | Dissolved N (mass %) | Microstructure | TSave (MPa) | TSσ (MPa) | RAave (%) | RAσ (%) |
|---|---|---|---|---|---|---|---|---|---|---|---|---|---|---|---|---|---|
| 1 | A | 1100 | 0.41 | 900 | 8 | 14.0 | 9.1 | 0.3 | 0.2 | 347 | 0.0008 | 0.0003 | P | 1293 | 9 | 24 | 1.5 |
| 2 | B | 1050 | 0.47 | 850 | 8 | 13.0 | 8.8 | 0.2 | 0.2 | 341 | 0.0007 | 0.0003 | P | 1266 | 7 | 31 | 0.8 |
| 3 | C | 1100 | 0.43 | 900 | 8 | 13.5 | 9.3 | 0.2 | 0.1 | 351 | 0.0003 | 0.0002 | P | 1306 | 7 | 29 | 1.2 |
| 4 | C | 1100 | 0.47 | 1000 | 2 | 13.0 | 6.5 | 0.5 | 0.9 | 341 | 0.0005 | 0.0005 | P | 1267 | 11 | 12 | 1.1 |
| 5 | C | 1100 | 0.43 | 800 | 31 | 13.5 | 10.5 | 0.5 | 0.8 | 402 | 0.0003 | 0.0003 | P | 1306 | 34 | 24 | 3.1 |
| 6 | C | 1100 | 0.27 | 910 | 4 | 13.0 | 7.5 | 0.7 | 0.5 | 346 | 0.0003 | 0.0003 | P | 1221 | 31 | 24 | 3.1 |
| 7 | C | 1100 | 0.60 | 840 | 32 | 9.0 | 11.0 | 0.3 | 0.2 | 431 | 0.0003 | 0.0003 | P + B | 1341 | 34 | 27 | 2.7 |
| 8 | D | 1000 | 0.51 | 850 | 14 | 8.0 | 7.9 | 0.4 | 0.4 | 337 | 0.0004 | 0.0004 | P | 1251 | 14 | 33 | 1.4 |
| 9 | E | 1000 | 0.46 | 900 | 11 | 10.0 | 8.1 | 0.3 | 0.3 | 379 | 0.0013 | 0.0002 | P | 1421 | 11 | 27 | 1.2 |
| 10 | F | 1150 | 0.51 | 920 | 14 | 8.0 | 8.7 | 0.1 | 0.2 | 369 | 0.0009 | 0.0004 | P | 1383 | 6 | 27 | 0.7 |
| 11 | G | 1150 | 0.51 | 850 | 14 | 8.0 | 9.6 | 0.3 | 0.2 | 344 | 0.0022 | 0.0002 | P | 1277 | 11 | 35 | 1.2 |
| 12 | H | 1000 | 0.47 | 940 | 5 | 13.0 | 7.6 | 0.6 | 1.0 | 354 | 0.0005 | 0.0005 | P | 1321 | 22 | 21 | 1.8 |
| 13 | I | 1000 | 0.46 | 850 | 12 | 9.0 | 8.6 | 0.2 | 0.1 | 339 | 0.0005 | 0.0001 | P | 1259 | 7 | 26 | 0.9 |
| 14 | J | 1150 | 0.45 | 900 | 17 | 6.4 | 8.5 | 0.4 | 0.5 | 379 | 0.0003 | 0.0003 | P | 1423 | 15 | 30 | 1.3 |
| 15 | K | 1100 | 0.46 | 900 | 18 | 6.0 | 9.0 | 0.3 | 0.2 | 344 | 0.0004 | 0.0001 | P | 1279 | 11 | 31 | 0.9 |
| 16 | L | 1100 | 0.46 | 900 | 18 | 6.0 | 9.3 | 0.5 | 0.8 | 389 | 0.0005 | 0.0005 | P | 1463 | 17 | 33 | 1.5 |
| 17 | M | 1100 | 0.43 | 870 | 7 | 16.0 | 8.9 | 0.3 | 0.3 | 329 | 0.0003 | 0.0002 | P | 1216 | 9 | 32 | 1.2 |
| 18 | N | 1150 | 0.47 | 880 | 8 | 13.0 | 9.2 | 0.8 | 1.5 | 334 | 0.0000 | 0.0001 | P | 1237 | 35 | 31 | 3.1 |
| 19 | O | 1150 | 0.48 | 870 | 14 | 8.0 | 9.3 | 0.4 | 0.4 | 363 | 0.0004 | 0.0015 | P | 1357 | 12 | 37 | 1.1 |
| 20 | P | 1100 | 0.42 | 820 | 8 | 13.0 | 9.2 | 0.7 | 1.2 | 292 | 0.0015 | 0.0005 | P | 1067 | 32 | 31 | 2.7 |
| 21 | Q | 1100 | 0.54 | 820 | 8 | 13.0 | 9.0 | 0.2 | 0.1 | 374 | 0.0014 | 0.0004 | P | 1403 | 12 | 12 | 1.1 |
| 22 | R | 1100 | 0.43 | 850 | 18 | 8.0 | 9.5 | 0.9 | 0.4 | 421 | 0.0004 | 0.0004 | P + B | 1256 | 38 | 11 | 3.1 |
| 23 | S | 1100 | 0.42 | 880 | 14 | 8.0 | 8.4 | 0.8 | 0.6 | 299 | 0.0008 | 0.0001 | P | 1121 | 35 | 31 | 2.8 |
| 24 | T | 1100 | 0.66 | 910 | 6 | 14.0 | 9.0 | 0.2 | 0.1 | 344 | 0.0003 | 0.0008 | P | 1254 | 7 | 29 | 1.2 |
| 25 | T | 1100 | 0.51 | 950 | 4 | 13.0 | 6.0 | 0.5 | 0.9 | 334 | 0.0005 | 0.0005 | P | 1217 | 11 | 12 | 1.1 |
| 26 | T | 1100 | 0.42 | 800 | 7 | 12.0 | 10.5 | 0.5 | 0.8 | 394 | 0.0003 | 0.0007 | P | 1254 | 34 | 27 | 3.2 |
| 27 | T | 1100 | 0.21 | 880 | 4 | 15.0 | 7.0 | 0.8 | 0.7 | 339 | 0.0002 | 0.0009 | P | 1173 | 30 | 24 | 3.1 |

TABLE 2-continued

| | | Hot-rolling condition | | | | Hot-rolled wire rod | | | | | | | | | | | |
|---|---|---|---|---|---|---|---|---|---|---|---|---|---|---|---|---|---|
| Test No. | Steel type | Heating temperature (° C.) | Area reduction strain ϵ * (—) | Placing temperature (° C.) | Cooling rate (° C./sec) | Wire diameter of hot-rolled wire rod (mm) | Pave | Pσ | Grain boundary α (area %) | Hardness (HV) | Dissolved B (mass %) | Dissolved N (mass %) | Microstructure | TSave (MPa) | TSσ (MPa) | RAave (%) | RAσ (%) |
| 28 | T | 1100 | 0.70 | 940 | 22 | 8.0 | 10.0 | 0.4 | 0.2 | 418 | 0.0003 | 0.0009 | P + B | 1321 | 41 | 25 | 4.1 |
| 29 | U | 1050 | 0.65 | 910 | 7 | 13.0 | 9.5 | 0.5 | 0.5 | 367 | 0.0004 | 0.0005 | P | 1270 | 13 | 24 | 1.2 |
| 30 | V | 1100 | 0.55 | 890 | 6 | 13.0 | 9.0 | 0.4 | 0.3 | 377 | 0.0003 | 0.0004 | P | 1304 | 17 | 27 | 1.5 |
| 31 | X | 1050 | 0.60 | 880 | 5 | 13.0 | 8.0 | 0.5 | 0.4 | 366 | 0.0005 | 0.0002 | P | 1267 | 15 | 26 | 1.7 |
| 32 | Y | 1150 | 0.48 | 900 | 6 | 13.0 | 7.5 | 0.4 | 0.5 | 378 | 0.0006 | 0.0003 | P | 1306 | 10 | 25 | 1.9 |
| 33 | Z | 1050 | 0.61 | 940 | 5 | 15.0 | 8.0 | 0.2 | 0.2 | 370 | 0.0003 | 0.0004 | P | 1280 | 12 | 26 | 1.1 |

The hot-rolled wire rod was subjected to microstructure evaluation, measurement of pearlite nodules (size number, standard deviation), hardness evaluation, the quantity of grain-boundary ferrite grains (the quantity of grain-boundary α), and evaluation of mechanical properties by the following methods. Table 2 shows results of such evaluations together with the amount of dissolved B and the amount of dissolved N in the hot-rolled wire rod. In the column "microstructure" in Table 2, "P" represents that at least 90 percent by area of the microstructure is pearlite", and "P+B" represents that more than 10 percent by area of bainite is mixed.

(Microstructure Evaluation of Hot-rolled Wire Rod)

Figure 2:
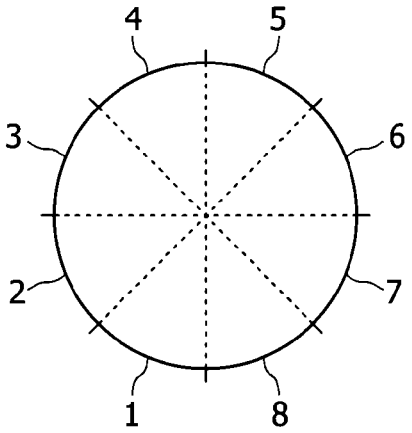
FIG. 2 is a schematic illustration for explaining a sampling method of a sample to be evaluated.

To evaluate a longitudinal variation in pearlite phase depending on coil density, the microstructure evaluation was conducted as follows. One ring was cut from an end of a non-defective product, and then the ring was divided into eight in a circumferential direction as illustrated in FIG. 2. A section (cross section) perpendicular to a longitudinal direction of each of the eight samples in total was observed by a light microscope to identify the microstructure.

(Measuring Procedure of Pearlite Nodule Size Number)

The pearlite nodule size number (P nodule size number) was measured in a surface portion, a D/4 portion (D is diameter of the wire rod), and a D/2 portion for each section. The average of such measurements was defined as P nodule size number Pi (i=1 to 8) for that section, and the average $P_{ave}$ and the standard deviation Pσ across P1 to P8 were calculated. The P nodule represents a region in which ferrite grains in a pearlite phase have the same orientation, and is measured as follows. First, each sample is buried in a resin, and a surface of the resin is polished to expose the section. The sample is then etched using a mixed solution of concentrated nitric acid and alcohol. The P nodule is then observed in a highlighted manner due to a difference in etching rate of the ferrite grains relative to the crystal face. The ferrite grains are observed using a light microscope, and the size number is determined based on "Measurement of Austenite Grain Size" described in JIS G 0551.

(Evaluation of Hardness)

The same samples as those for the P nodule size number were prepared. The Vickers hardness of each sample was measured with a load 1 kgf at four points in the D/4 portion (D is diameter of the wire rod) and at one point in the D/2 portion, i.e., at five points in total. The average of the five measurements was defined as hardness HVi (i =1 to 8) for the relevant section, and the average across HV1 to HV8 was defined as "hardness" of the hot-rolled wire rod. The surface portion was not evaluated because the portion probably had a high ferrite fraction due to decarbonization.

(Evaluation of Quantity of Grain-boundary Ferrite Grains)

A mixed solution of trinitrophenol and ethanol was used as an etchant so that the grain-boundary ferrite grains were highlighted white; hence, the area ratio of the grain-boundary ferrite grains can be determined through image analysis. First, each sample was buried in a resin, and a surface of the resin was polished to expose the section. The sample was then etched using the mixed solution. The grain-boundary ferrite grains appearing after the etching were photographed at 400 magnifications at the total of two points in the D/4 portion and the D/2 portion for each section, and were thus evaluated in 16 visual fields in total. In Table 2, "grain-boundary α" represents the average of the 16 measurements. The surface portion was not evaluated because the portion probably had a high ferrite fraction due to decarbonization.

(Evaluation of Mechanical Properties of Hot-rolled Wire Rod)

For the mechanical properties of the hot-rolled wire rod, eight-segmented samples, which were taken in the same manner as with the microstructure evaluation, were each subjected to a tensile test, and tensile strength TS and reduction of area RA were evaluated. The average ($TS_{ave}$) of the tensile strength TS and the average ($RA_{ave}$) of the reduction of area RA were obtained for the eight measurements in total, and the standard deviation TSσ of the tensile strength TS and the standard deviation RA σ of the reduction of area RA were calculated.

A steel wire produced through wire-drawing of the hot-rolled wire rod was subjected to hot-dip galvanization treatment, so that a galvanized steel wire was produced. The mechanical properties and toughness (torsion characteristics) of the galvanized steel wire were evaluated in the following manner.

(Evaluation of Mechanical Properties of Steel Wire)

Each of the hot-rolled wire rods was formed into a predetermined wire diameter listed in Table 3 by cold drawing, and was then dipped for about 30 sec in molten zinc at 440 to 460° C. to produce a galvanized steel wire. The tensile strength TS was determined by a tensile test while the length L of the steel wire was 500 mm. The average for 50 tests was defined as the average ($WTS_{ave}$) of the tensile strength TS, and the standard deviation of the tensile strength TS was defined as WTSσ. The mechanical properties of the steel wire after wire-drawing were determined in this way in order to evaluate influence of a variation in coil density on a variation in strength of the drawn wire. For example, length of a wire rod increases 5.4 times through wire-drawing from a diameter 14 mm to a diameter 6 mm. Hence, when the circumferential length of a ring is assumed to be 4 m, the steel wire after wire-drawing is estimated to have a periodic variation in a period of about 22 m.

(Evaluation of Toughness of Steel Wire)

Toughness of each of the steel wires was determined by a torsion test. Fifty (n=50) of the hot-dip galvanized steel wires were each subjected to a torsion test to determine a torsion value and presence of longitudinal cracking. For the torsion value, the number of times of torsion before break was normalized with a chuck-to-chuck distance of 100 mm, and the average for 50 tests was defined as the torsion value. Presence of longitudinal cracking was determined through fracture observation, and the number (proportion relative to fifty steel wires) of the steel wires, each showing a fracture in a longitudinal crack shape, was measured.

Table 3 shows results of such measurements together with wire diameters after wire-drawing and area reduction ratios in wire-drawing.

TABLE 3

| | | Galvanized steel wire | | | | | |
|---|---|---|---|---|---|---|---|
| Test No. | Steel type | Wire diameter (mm) | Area reduction ratio (%) | WTSave (MPa) | WTSσ (MPa) | Torsion value (the number of times) | The number of longitudinal cracks |
| 1 | A | 5.2 | 86.2 | 2103 | 22 | 34 | 0/50 |
| 2 | B | 5.1 | 84.6 | 2034 | 13 | 34 | 0/50 |
| 3 | C | 5.2 | 85.2 | 2140 | 20 | 32 | 0/50 |
| 4 | C | | | | Wire breaking | | |
| 5 | C | | | | Dice seizing | | |
| 6 | C | 5.3 | 83.4 | 2081 | 67 | 12 | 17/50 |
| 7 | C | | | | Wire breaking | | |
| 8 | D | 2.9 | 86.9 | 2203 | 18 | 42 | 0/50 |
| 9 | E | 3.7 | 86.3 | 2274 | 22 | 31 | 0/50 |
| 10 | F | 2.8 | 87.8 | 2301 | 11 | 46 | 0/50 |
| 11 | G | 2.9 | 86.9 | 2206 | 21 | 36 | 0/50 |
| 12 | H | 5.1 | 84.6 | 2140 | 40 | 44 | 0/50 |
| 13 | I | 3.3 | 86.6 | 2168 | 21 | 32 | 0/50 |
| 14 | J | 2.3 | 87.1 | 2301 | 16 | 31 | 0/50 |
| 15 | K | 2.4 | 84.0 | 2268 | 22 | 33 | 0/50 |
| 16 | L | 2.2 | 86.6 | 2311 | 27 | 32 | 0/50 |
| 17 | M | 5.8 | 86.9 | 2312 | 24 | 43 | 0/50 |
| 18 | N | 5.2 | 84.0 | 2097 | 61 | 37 | 7/50 |
| 19 | O | 3.2 | 84.0 | 2234 | 26 | 21 | 2/50 |
| 20 | P | 4.5 | 88.0 | 1820 | 58 | 22 | 8/50 |
| 21 | Q | | | | Wire breaking | | |
| 22 | R | | | | Wire breaking | | |
| 23 | S | 3.2 | 84.0 | 2031 | 71 | 11 | 19/50 |
| 24 | T | 5.1 | 86.7 | 2130 | 22 | 22 | 0/50 |
| 25 | T | | | | Wire breaking | | |
| 26 | T | | | | Dice seizing | | |
| 27 | T | 5.3 | 87.5 | 2061 | 66 | 11 | 19/50 |
| 28 | T | | | | Wire breaking | | |
| 29 | U | 5.3 | 83.4 | 2167 | 24 | 24 | 0/50 |
| 30 | V | 4.9 | 85.8 | 2197 | 22 | 23 | 0/50 |
| 31 | X | 5.2 | 84.0 | 2145 | 18 | 22 | 0/50 |
| 32 | Y | 7.0 | 71.0 | 2049 | 16 | 25 | 0/50 |
| 33 | Z | 7.0 | 78.2 | 2089 | 23 | 23 | 0/50 |

The following consideration can be made from such results. Specifically, Test Nos. 1 to 3, 8 to 17, 19, 24, and 29 to 33 each satisfy all the requirements defined in the invention, in any of which at least 90 percent by area of the microstructure is a pearlite phase. The galvanized steel wire after wire-drawing has the same microstructure as that of the wire rod after hot rolling. In addition, any defect such as wire breaking is not found during wire-drawing, and strength and torsion characteristics of the steel wire are good after hot-dip galvanization treatment (the torsion value is 20 or more). Among them, Test No. 19 has a slightly large amount of dissolved N, and has a relatively low torsion value in the examples.

In contrast, Test Nos. 4 to 7, 18, 20 to 23, and 25 to 28 are examples that each do not satisfy the requirements defined in the invention or the preferred requirements, in each of which a defect such as wire breaking is found during wire-drawing, or wire strength or torsion characteristics is/are bad after hot-dip galvanization treatment.

For Test No. 4, placing temperature is high, and cooling rate during placing is low, and thus the average $P_{ave}$ of the size number of the pearlite nodule is small, and ductility of the wire rod is low, resulting in occurrence of wire breaking during wire-drawing. For Test No. 5, the placing temperature is low, and cooling rate during placing is high, and thus the average $P_{ave}$ of the size number of the pearlite nodule is large, and hardness of the wire rod is high, resulting in occurrence of dice seizing during wire-drawing. For Test No. 6, the area reduction strain $\epsilon$ during hot rolling is small, and cooling rate during placing is low, and thus the standard deviation Pσ of the size number of the pearlite nodule is large; hence, a variation in strength of the steel wire is large (WTSσ>40 MPa), resulting in a small torsion value and frequent occurrence of longitudinal cracking. For Test No. 7, average cooling rate during placing is high, and the average $P_{ave}$ of the size number of the pearlite nodule is large, and thus a bainite phase is formed, resulting in occurrence of wire breaking during wire-drawing.

Test No. 18 is an example of using the steel type N having a low B content, in which the quantity of grain-boundary ferrite grains is larger than 1.0, and the standard deviation Pσ is large, and thus a variation in strength of the steel wire is large, resulting in degradation in torsion characteristics, i.e., frequent occurrence of longitudinal cracking. Test No.

20 is an example of using the steel type P having a low C content, in which the grain-boundary ferrite grains are not sufficiently decreased, and the standard deviation Pσ is large, and thus a variation in strength of the steel wire is large, resulting in degradation in torsion characteristics, i.e., frequent occurrence of longitudinal cracking.

Test No. 21 is an example of using the steel type Q having an excessive C content, in which proeutectoid cementite precipitates, resulting in occurrence of wire breaking during wire-drawing. Test No. 22 is an example having a high carbon equivalent $C_{eq}$, in which transformation is not completed on the conveyer, and thus the standard deviation Pσ is large, and a bainite phase is partially formed, resulting in occurrence of wire breaking during wire-drawing. Test No. 23 is an example having a low carbon equivalent $C_{eq}$, in which the transformation time is short, and thus the standard deviation Pσ is large, and a variation in strength of the wire is large, resulting in a small torsion value and frequent occurrence of longitudinal cracking.

For Test No. 25, cooling rate during placing is low, and the average $P_{ave}$ of the size number of the pearlite nodule is small, and thus ductility of the wire rod is low, resulting in occurrence of wire breaking during wire-drawing. For Test No. 26, the placing temperature is low, and the average $P_{ave}$ of the size number of the pearlite nodule is large, and thus hardness of the wire rod is high, resulting in occurrence of dice seizing during wire-drawing. For Test No. 27, cooling rate during placing is low, and area reduction strain ϵ during hot rolling is small, and thus the standard deviation Pσ of the size number of the pearlite nodule is large; hence, a variation in strength of the steel wire is large (WTSσ>40 MPa), resulting in a small torsion value and frequent occurrence of longitudinal cracking. For Test No. 28, average cooling rate during placing is high, and a bainite phase is formed, resulting in occurrence of wire breaking during wire-drawing.

Figure 3:
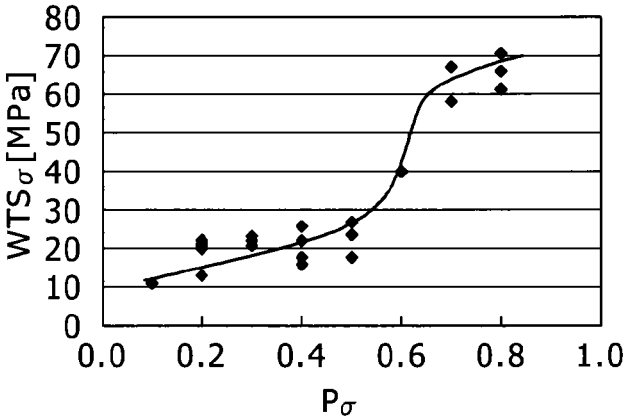
FIG. 3 is a graph illustrating a relationship between standard deviation Pσ of a size number of a pearlite nodule of a hot-rolled wire rod and standard deviation WTSσ of tensile strength TS of a steel wire.

FIG. 3 illustrates a relationship between the standard deviation Pσ for the hot-rolled wire rod and the standard deviation WTSσ of the tensile strength TS of the steel wire in Table 3. This relationship is on the examples of Test Nos. 1 to 3, 6, 8 to 20, 23, 24, 27, and 29 to 33, in each of which neither wire breaking nor dice seizing occurs. This results reveal that as the standard deviation Pσ for the hot-rolled wire rod decreases, the standard deviation WTSσ for the steel wire decreases, i.e., a variation in strength relatively decreases.

LIST OF REFERENCE SIGNS

1 to 8 Hot-rolled wire rod
10 Dense part
11 Sparse part

The invention claimed is:

1. A high-strength steel wire rod having good rod drawability, comprising:

C: 0.80 to 1.3% (by mass percent (the same applies to the following for the components));
Si: 0.1 to 1.5%;
Mn: 0.1 to 1.5%;
P: more than 0% and 0.03% or less;
S: more than 0% and 0.03% or less;
B: 0.0005 to 0.01%;
Al: 0.01 to 0.10%;
N: 0.001 to 0.006%; and
the remainder being iron and inevitable impurities,
wherein, in a microstructure of the steel wire rod, an area ratio of pearlite is 90% or more, and an average $P_{ave}$ and standard deviation Pσ of a pearlite nodule size number satisfy Formulas (1) and (2), respectively, $$7.0 \leq P_{ave} \leq 10.0 \quad (1) \text{ and}$$

$$P\sigma \leq 0.6 \quad (2).$$

2. The high-strength steel wire rod according to claim 1, wherein an area ratio of grain-boundary ferrite grains is 1.0% or less.

3. The high-strength steel wire rod according to claim 1, wherein $C_{eq}$ is 0.85 to 1.45%, the $C_{eq}$ being represented by Formula (3)

$$C_{eq}=[C]+[Si]/24+[Mn]/6+[Ni]/40+[Cr]/5+[Mo]/4+[V]/14 \quad (3),$$

where [C], [Si], [Mn], [Ni], [Cr], [Mo], and [V] represent the respective contents (by mass percent) of C, Si, Mn, Ni, Cr, Mo, and V.

4. The high-strength steel wire rod according to claim 3, further comprising at least one element selected from:

(a) Cr: more than 0% and 0.5% or less;
(b) V: more than 0% and 0.2% or less;
(c) at least one element selected from the group consisting of Ti: more than 0% and 0.2% or less and Nb: more than 0% and 0.5% or less;
(d) at least one element selected from the group consisting of W: more than 0% and 0.5% or less and Co: more than 0% and 1.0% or less;
(e) Ni: more than 0% and 0.5% or less; and/or
(f) at least one element selected from the group consisting of Cu: more than 0% and 0.5% or less and Mo: more than 0% and 0.5% or less.

5. A high-strength steel wire produced through wire-drawing of the high-strength steel wire rod according to claim 4.

6. A high-strength galvanized steel wire produced by performing hot-dip galvanization on the high-strength steel wire according to claim 5, wherein standard deviation WTSσ of tensile strength TS satisfies Formula (4)

$$WTS\sigma \leq 40 (\text{MPa}) \quad (4).$$

* * * * *